US005853547A

United States Patent [19]

Ahrens et al.

[11] Patent Number: 5,853,547

[45] Date of Patent: Dec. 29, 1998

[54] PAPERMAKING FABRIC, PROCESS FOR PRODUCING HIGH BULK PRODUCTS AND THE PRODUCTS PRODUCED THEREBY

[75] Inventors: Frederick W. Ahrens, Hortonville, Wis.; Thomas Gulya, Raleigh, N.C.; Gary L. Worry, Appleton; Walter P. Wright, Larsen, both of Wis.

[73] Assignee: Asten, Inc., Charleston, S.C.

[21] Appl. No.: 733,934

[22] Filed: Oct. 18, 1996

Related U.S. Application Data

[63] Continuation of Ser. No. 628,235, Apr. 4, 1996, abandoned.

[51] Int. Cl.[6] ..... D21F 1/10

[52] U.S. Cl. ..... 162/348; 162/903; 162/904; 139/425 A; 442/203; 442/312

[58] Field of Search ..... 162/202, 296, 162/348, 358.1, 900, 903, 904; 442/312, 203; 139/425 A; 245/2, 8

[56] References Cited

U.S. PATENT DOCUMENTS

| | | | |
|---|---|---|---|
| 3,301,746 | 1/1967 | Sanford et al. | 162/113 |
| 3,573,164 | 3/1971 | Friedberg et al. | 162/348 |
| 3,603,354 | 9/1971 | Lee | 139/383 |
| 3,905,863 | 9/1975 | Ayers | 162/113 |
| 4,182,381 | 1/1980 | Gisbourne | 139/383 A |
| 4,191,609 | 3/1980 | Trokhan | 162/113 |
| 4,239,065 | 12/1980 | Trokhan | 139/383 A |
| 4,281,688 | 8/1981 | Kelly et al. | 139/383 A |
| 4,423,755 | 1/1984 | Thompson | 139/383 A |
| 4,909,284 | 3/1990 | Kositzke | 139/383 A |
| 4,989,648 | 2/1991 | Tate et al. | 139/383 A |
| 4,995,428 | 2/1991 | Tate et al. | 139/383 A |
| 4,998,569 | 3/1991 | Tate | 139/383 A |
| 5,013,330 | 5/1991 | Durkin et al. | 51/297 |
| 5,151,316 | 9/1992 | Durkin et al. | 428/213 |
| 5,158,118 | 10/1992 | Tate et al. | 139/383 A |
| 5,211,815 | 5/1993 | Ramasubramanian et al. | 162/348 |
| 5,368,696 | 11/1994 | Cunnane, III et al. | 162/358.2 |
| 5,456,293 | 10/1995 | Ostermayer et al. | 139/383 A |
| 5,542,455 | 8/1996 | Ostermayer et al. | 139/383 A |

*Primary Examiner*—Peter Chin
*Assistant Examiner*—Steven B. Leavitt
*Attorney, Agent, or Firm*—Volpe and Koenig, P.C.

[57] ABSTRACT

The present invention is an improved 7,3-broken twill, TAD fabric for use in the formation of a paper web. The present invention is also a process of using this fabric to produce a paper product having high bulk and absorbency. Finally, the present invention is the paper product produced in a TAD process using this fabric.

18 Claims, 8 Drawing Sheets

PAPERMAKING FABRIC, PROCESS FOR PRODUCING HIGH BULK PRODUCTS AND THE PRODUCTS PRODUCED THEREBY

This application is a continuation of U.S. patent application Ser. No. 08/628,235, filed Apr. 4, 1996, now abandoned.

FIELD OF THE INVENTION

The present invention relates to a fabric for use in the production of a paper product using through-air drying (TAD). The present invention further relates to a process for producing a high bulk, absorbent paper product. The invention also relates to a paper product produced by a through-air drying process using the fabric of the invention.

BACKGROUND OF THE INVENTION

A feature of modern society is the use of disposable sanitary products such as paper towels, facial tissue, bathroom tissue, and table napkins. As the use of these products has permeated society, greater demand for disposable products has been generated. This demand coupled with a competitive environment requires the continuous development of new and improved sanitary products. Advances in research and development efforts by consumer product companies and vendors continue to generate new methods/materials for improving sanitary products.

Disposable sanitary products such as paper towels, facial tissue, bathroom tissue and table napkins require certain physical attributes in order to perform satisfactorily. Absorbency, strength (both wet and dry), and softness are among the most important and desirable characteristics of disposable sanitary products. Absorbency is the ability of a product to absorb and retain liquid. Both the quantity of liquid absorbed and the rate of liquid pick up are important attributes describing the absorbency of a sanitary product. Strength is the property of a paper product that causes the product to be held together while in use. Finally, softness is the product property accounting for the pleasing tactile sensations imparted to the human anatomy while the product is in use.

These three product attributes often run counter to one another. For example, as strength is increased, softness and absorbency generally decrease. Consumer product companies and vendors are constantly searching for methods/materials to either increase softness and absorbency while maintaining or increasing strength or to increase strength while maintaining or increasing absorbency and softness.

The physical attributes of a paper web are controlled not only by the chemical composition of the web itself, but often by the process by which the web is produced. Fibrous webs can be produced using standard wet press technology which physically presses and dewaters a web prior to drying of the web on a Yankee dryer. This method has the disadvantage of compressing the web during the physical pressing, thereby reducing the bulk, absorbency and softness of the web. Alternatively, a web may be subjected to vacuum deformation, alone or in conjunction with other physical deformation processes, on an impression fabric and a TAD drying step which dries the web to a solids content of at least about 30% without the need for overall physical compression. This type of process is conventionally referred to as a through-air-drying or TAD process. This process is generally described in U.S. Pat. No. 3,301,746, to Sanford et al. and U.S. Pat. No. 3,905,863 to Ayers, which are incorporated herein in their entirety by reference.

As an example, one conventional TAD process is illustrated in FIG. 1. In this process, fibers are fed from a headbox (10) to a converging set of forming wires (20,30). In this twin wire forming arrangement water is removed from the web by centrifugal forces and by vacuum means. The wet nascent web is cleanly transferred to forming wire (30) via Uhle box (40). The web can be optionally processed to remove water by vacuum box (50) and steam shroud (60). The web is carried along forming fabric (30) until it is transferred to a TAD fabric (70) at junction (80) by means of a vacuum pickup shoe (90). The web is further dewatered at dewatering box (100) to increase web solids. Besides removing water from the web, vacuum pickup shoe (90) and dewatering box (100) inundate the web into TAD fabric (70) causing bulk and absorbency characteristics.

Further enhancements in bulk and absorbency can be obtained by operating the speed of the forming section (i.e., the speeds of forming fabrics 20 and 30) faster than the speed of TAD fabric (70). This is referred to as fabric/fabric creping. In this manner the web is inundated and wet shaped into the fabric creating bulk and absorbency. Thickness created by wet shaping is more effective in generating absorbency (i.e. less structural collapse) than thickness created in the dry state, e.g. by conventional embossing. The web is then carried on the TAD fabric (70) to a drying unit (110) where heated air is passed through both the web and the fabric to increase the solids content of the web. Generally, the web is 30 to 95% dry after exiting drying unit (110). If sufficiently dried, the web may then be removed directly to reel (170). Otherwise, the web can be carried on TAD fabric (70) to pressure roll (120) where it is pressed to the surface of Yankee dryer (130) to create a pattern-densified web having high bulk, absorbency, and strength. After the web exits the nip of pressure roll (120), it is dried along the periphery of the Yankee dryer with steam and with hot air ejected from Yankee hood (140). The web is creped from the Yankee dryer by creping blade (150), optionally calendered by rollers (160) and wound onto reel (170) to await further processing.

The TAD fabric that is used to support the web and to form an impression in the web plays a central role in the development of the product attributes that may be obtained. The fabric character also has a significant effect on processing attributes such as runnability and productivity.

In a TAD process, orientation of the fabric is important in determining what the physical attributes of the impressed web will be. Sheet side of the fabric refers to that side of the fabric which is generally used to contact the aqueous wet web and impress the web. Back side refers to the side of the fabric which generally does not contact the web. Fabric orientation is very important because as discussed below, a fabric which is believed to be inappropriate when oriented on the sheet side may find use as a TAD fabric if reoriented so that the backside contacts the nascent web.

A variety of types of TAD fabrics have been proposed in an attempt to achieve good product attributes and processing efficiency. Early TAD fabrics were primarily single layer, plain weave, semi-twill, 4-shed or 5-shed fabrics. U.S. Pat. No. 3,301,746 disclosed the use of square, diagonal twill and semi-twill weaves while U.S. Pat. No. 3,974,025 disclosed the use of the back surface of a semi-twill TAD fabric. Another early development in TAD fabric technology is disclosed in U.S. Pat. No. 4,239,065 to Trokhan. This patent discloses specific weaves wherein the top-surface crossovers define a bilaterally staggered array of wicker-basket-like cavities where each cavity spans at least one sub-top-crossover.

TAD fabrics create bulk in a fibrous web by compacting the web only along raised areas that correspond to overlying machine direction and/or cross direction filaments. Large portions of the fibrous web contact the fabric in the open areas or baskets between the raised filaments and thus, are not compressed during the TAD drying pattern densification process. In fact, these uncompressed areas are not only soft and absorbent but they are generally deformed to correspond to the baskets, thus resulting in a higher bulk product. Single layer woven fabrics have the advantages that they are inexpensive and efficient without creating difficult processing problems. However, these fabrics have the drawback that as the open areas are made larger, i.e., the size of the baskets which form non-compressed areas of the fibrous web are increased, these fabrics provide insufficient support of the fibrous web. Lack of web support causes pinhole formation in the web, fiber bleed-through at the vacuum boxes, and air channeling, reducing both vacuum dewatering efficiency and TAD drying efficiency. Pinholing can negatively impact paper attributes including strength and visual appearance.

The next significant advancement in TAD fabric development was the photopolymer technology disclosed in U.S. Pat. Nos. 4,514,345; 4,529,480 4,528,239; 4,637,859; 5,059,283; 5,093,235; 5,098,522; 5,260,171; 5,275,700 5,384,289 and 5,364,504, which are incorporated herein by reference in their entirety. A photopolymer TAD fabric is composed of a fabric and a framework resulting in conduits. The framework is composed of photopolymer crosslinked material. These TAD fabrics provide a pattern of recesses and land areas on the sheet side of the fabric which contacts the fibrous web. These fabrics solve the problems of large open baskets versus web support by patterning the photopolymer material with large open conduits which are backed by a fine foraminious fabric which supports the paper web as it is imprinted by vacuum means and/or by fabric/fabric creping. These fabrics may also suffer from processing drawbacks such as seam development, short fabric life due to ridging at the vacuum boxes, higher fabric costs and chemical degradation of the photopolymer material in the hot humid environment of the through air dryer.

Other TAD fabrics have been proposed to expand the size of the open areas while overcoming the support problems suffered by single layer woven fabrics. These fabrics include for example, multi-layer fabrics. One such fabric is a two layer fabric that uses a finer layer above a coarser layer. One example of this type of two layer fabric is described in U.S. Pat. No. 4,759,391. Multi-layer fabrics suffer from processing drawbacks such as increased water loads held by the fabric after cleaning ultimately degrading TAD drying efficiencies.

Additional TAD fabrics that have been developed include load-bearing and "sculpture layers" having machine direction (MD) knuckles on the web contact side with valleys in between the knuckles. One example of such a fabric is described in U.S. Pat. No. 5,429,686. Another TAD fabric that was developed to provide a web support surface defines baskets and troughs extending transversely along and across the MD-CD plane of the fabric as disclosed in U.S. Pat. No. 5,456,293.

These prior fabrics suffer from the disadvantage that as base sheet attributes are improved, the fabric design becomes more complex and thus more costly. Further, coarser fabrics which are necessary to form large non-compressed areas in the paper web do not have the necessary structural support for the web.

Prior art fabrics such as those described in U.S. Pat. Nos. 4,989,648 and 4,423,755 provide laid in filaments or yarns to lend surface support to a fabric during a forming process. As used herein "laid in" filaments refer to those which lend structural integrity to a fabric but which do not form a part of the woven fabric pattern. In those fabrics, the support yarns ride along the upper surface of the fabric to improve fabric support and rigidity. These fabrics, which are known forming fabrics, would create large compressed areas in a fibrous web due to the presence of the long float support filaments on the surface of the fabric resulting in overall compaction of the applied web.

The present invention overcomes all of these drawbacks associated with the prior art by providing a single layer woven fabric with sufficiently large open area to produce a soft, bulky paper web without the formation of pinholes, fiber bleed-through at the vacuum boxes and air channeling problems. Furthermore, the present invention addresses these drawbacks without resort to highly complex, expensive structures.

SUMMARY OF THE INVENTION

It is therefore an object of the present invention to overcome these and other difficulties encountered in the prior art.

It is also an object of the present invention to provide a through air drying fabric which is simple and inexpensive yet which produces a bulky and absorbent paper sheet.

It is further an object of the present invention to provide a fabric which reduces fiber bleed through and the occurrence of pin holes. More particularly, it is an object of the present invention to prevent fiber bleed through during fabric to fabric creping.

It is still further an object of the present invention to provide a process exhibiting improved productivity, dewatering and drying efficiency.

Finally, it is an object of the present invention to provide a soft, high bulk, absorbent paper product.

These and other objects have been achieved by the present invention which relates to a papermaker's fabric for forming and transporting an aqueous paper web comprising a single layer fabric having machine direction filaments of a first diameter and cross direction filaments of a second diameter which are interwoven to form a pattern of knuckles and baskets; the fabric further having third diameter cross direction filaments which alternate with the second diameter cross direction filaments and form central support members at the bottom of said baskets.

The invention further provides a papermaking apparatus having at least one through-dryer papermaker's fabric having a paper carrying surface for forming and transporting an aqueous paper web, the improvement wherein the through-dryer papermaking fabric comprises a single layer fabric having machine direction filaments of a first diameter and cross direction filaments of a second diameter which are interwoven to form a pattern of knuckles and baskets; the fabric having third diameter cross direction filaments which alternate with the second diameter cross direction filaments and form substantially centrally located support members at the bottom of the baskets.

The invention still further provides a method of making a paper product comprising providing an aqueous dispersion of papermaking fibers; forming a nascent web; contacting the web with fabric having a plurality of knuckles and baskets, wherein the baskets are perimetrically defined by at least two machine direction filaments of a first diameter and two cross direction filaments of a second diameter and the bottom of the baskets are defined by at least one cross direction filament having a smaller diameter than the second diameter; creating an impression from the fabric in the web; and passing heated air through the fabric and the web.

The present invention further provides a paper web formed by a process comprising blowing heated air through a nascent web in contact with a trigonal impression fabric, the fabric having a plurality of knuckles and having large and small baskets, wherein the large and small baskets alternate and are aligned in the cross direction, and wherein the large and small baskets each are aligned in the diagonal directions, the baskets being defined by first diameter filaments in the machine direction and second diameter filaments in the cross direction and wherein the baskets have third diameter filaments at the bottom thereof for web support, wherein the third diameter filaments are smaller than the second diameter filaments.

Finally, the present invention provides a paper web imprinted by contacting the web with heated air and an impression fabric having a plurality of knuckles and baskets, wherein the baskets are perimetrically defined by at least two machine direction filaments and two cross direction filaments, preferably of equal diameter and the bottoms of the baskets are defined by at least one cross direction filament having a smaller diameter than the other yarns, comprising a fibrous pulp which is arranged into substantially compacted and substantially uncompacted areas; at least 10% of the area of the web having substantially uncompacted areas having a size of at least 40 mils by 40 mils.

Additional objects and advantages of the present invention will be apparent from the description, or may be learned by practice of the invention. The objects and advantages of the invention will be realized by the elements and combinations particularly pointed out in the appended claims.

DETAILED DESCRIPTION

When a wet fibrous web is presented to an impression fabric, the fabric imparts to the web areas of compression and areas of non-compression. The compressed areas are formed by the raised filaments or yarns that pass over contiguous filaments or yarns. These raised filaments create a pattern of knuckles or floats. The areas between the knuckles or floats (as used herein, knuckles will refer to raised filaments that pass over one filament and floats pass over two more filaments) are referred to herein as baskets or basket-like depressions. The pattern of these baskets is transferred to the fibrous web as non-compressed areas which are referred to herein as nubs.

The present invention addresses the drawbacks of the prior art fabrics by adding an internal support structure to a single layer fabric in the form of a reduced diameter cross direction support filament or yarn. Unlike prior art fabrics, the fabric of the present invention can render it practical to increase the basket size for forming non-compressed fibrous material by using additional smaller diameter shute filaments to improve the web support at the bottom of the basket areas.

Figure 2:
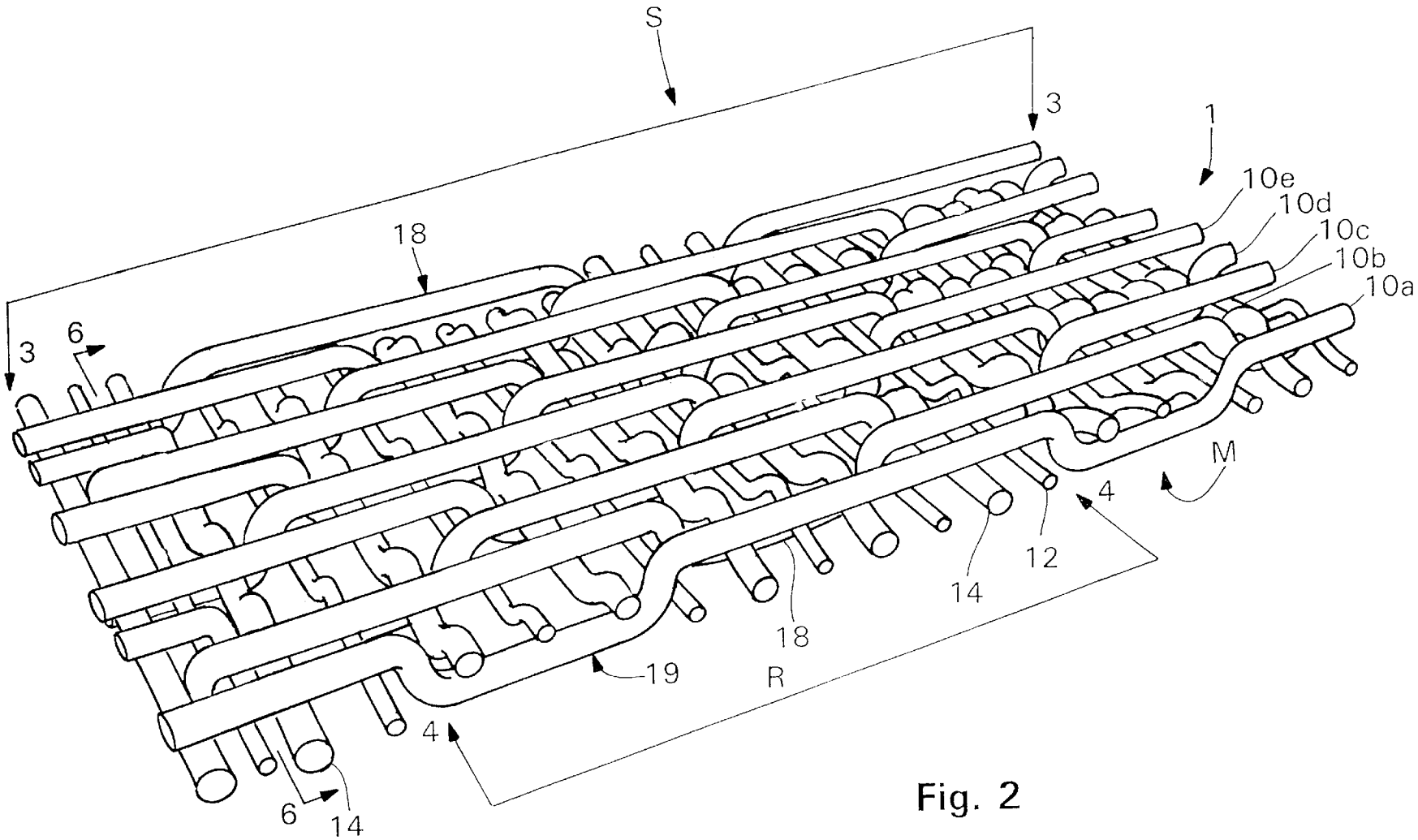
FIG. 2 is a perspective view of a preferred embodiment of a papermaking fabric in accordance with the present invention.
Figure 3:
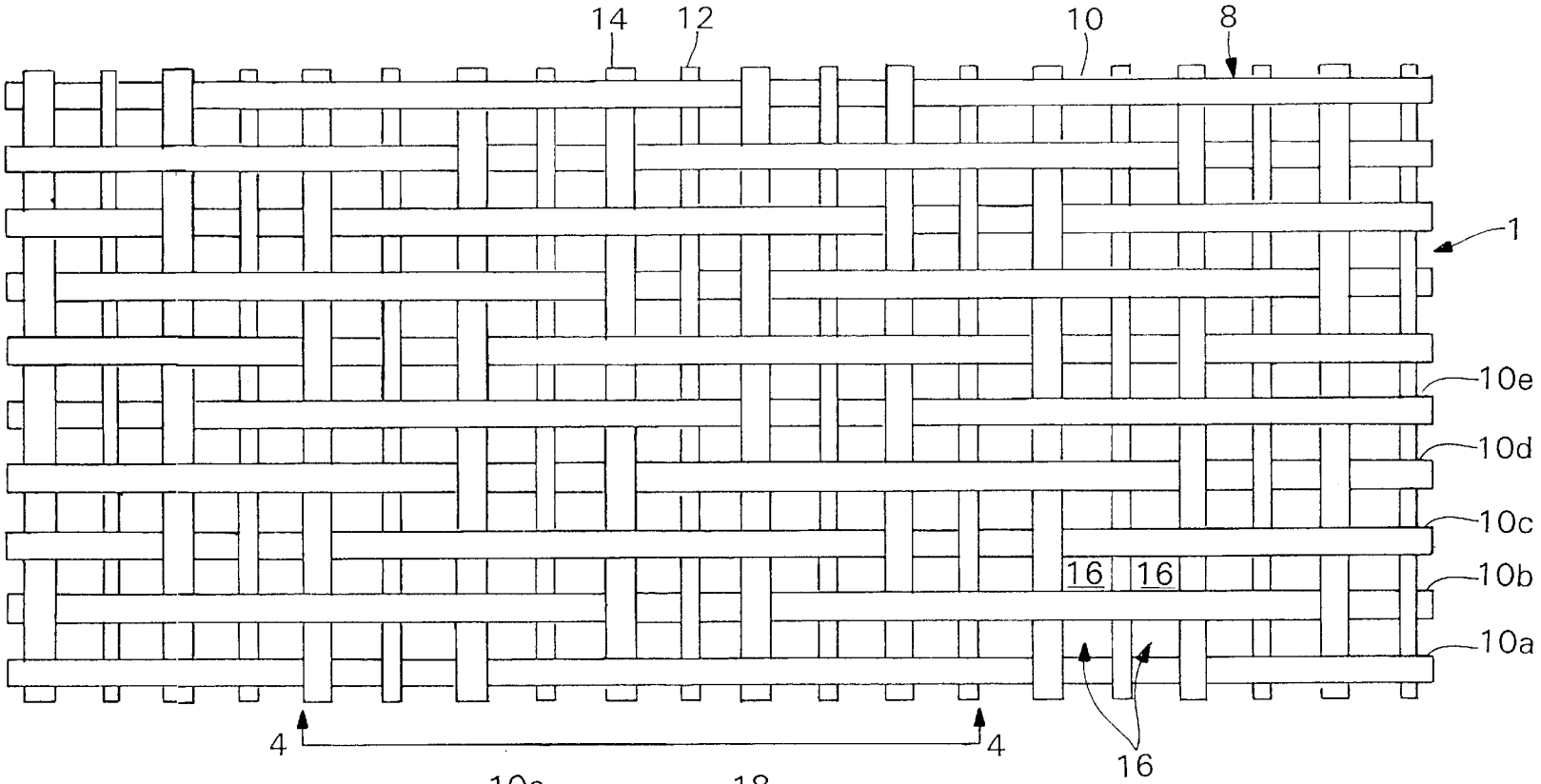
FIG. 3 is a top plan view of the papermaking fabric taken along line 3—3 in FIG. 2.
Figure 4:
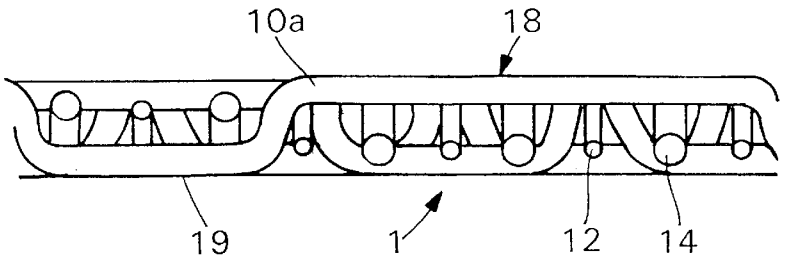
FIG. 4 is a side elevation of the papermaking fabric taken along line 4—4 in FIG. 3.
Figures 5A, 5B, 5C, 5D, 5E:
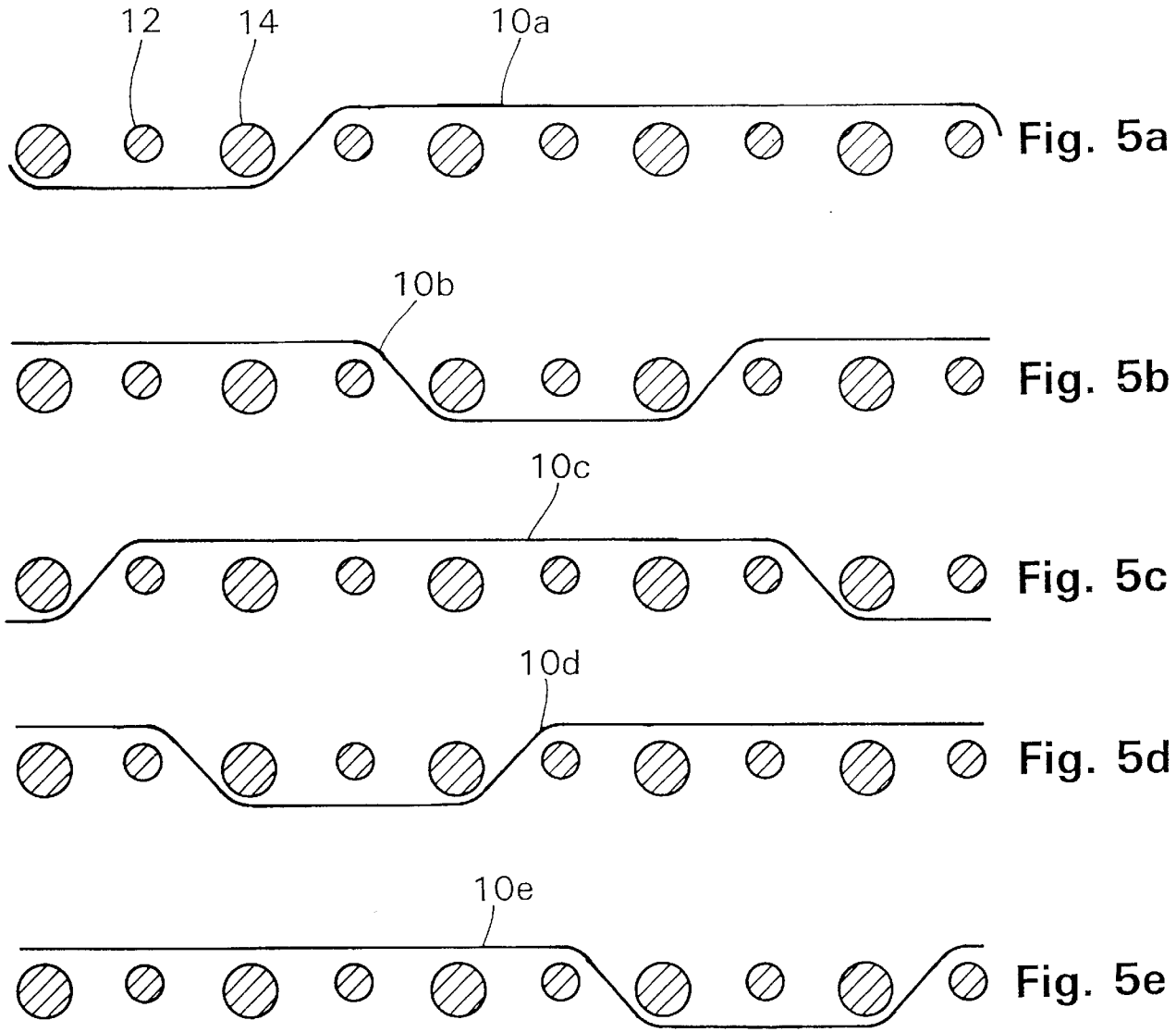
FIGS. 5*a–e* is a series of diagrammatic views illustrating the MD yarn weave pattern for the papermaking fabric of FIG. 2.

Referring to FIGS. 2–4, fabric 1 is shown in a 7/3 broken twill weave in accordance with the teachings of the present invention. Machine direction filaments (MD) 10 are interwoven with a system of alternating smaller and larger diameter cross direction filaments(CD) 12, 14. The fabric has a sheet side S, see FIG. 3, and a machine side M, not separately illustrated, with the sheet side of fabric 1 defining the paper characteristics.

FIGS. 5*a–e* further illustrate the weave repeat R of FIG. 2. Each MD filament 10 weaves over seven, and under three CD filaments 12, 14. Under each sheet side MD float 18 there are four smaller diameter CD filaments 12 and three larger diameter CD filaments 14. The smaller diameter CD filaments 12 are positioned on each side of each larger diameter CD filament 14. Over each machine side MD float 19 there are one smaller diameter CD filament 12 and two larger diameter CD filaments 14. The smaller diameter CD filament 12 is parallel to and between the two larger diameter CD filaments 14. These relationships should be maintained in any weave variations from the above described weave.

Figure 6:
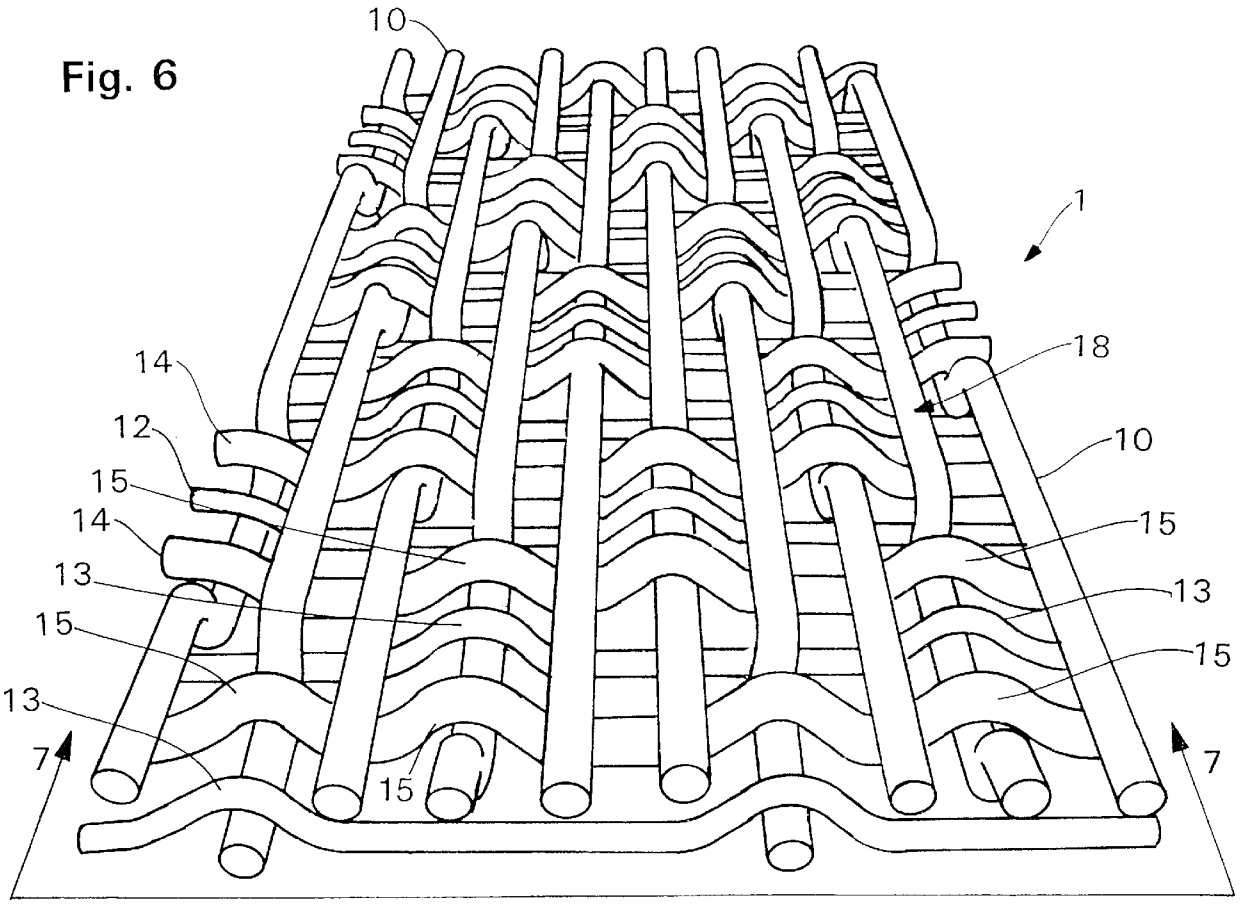
FIG. 6 is a side perspective view of the papermaking fabric taken along line 6—6 in FIG. 2.
Figure 7:
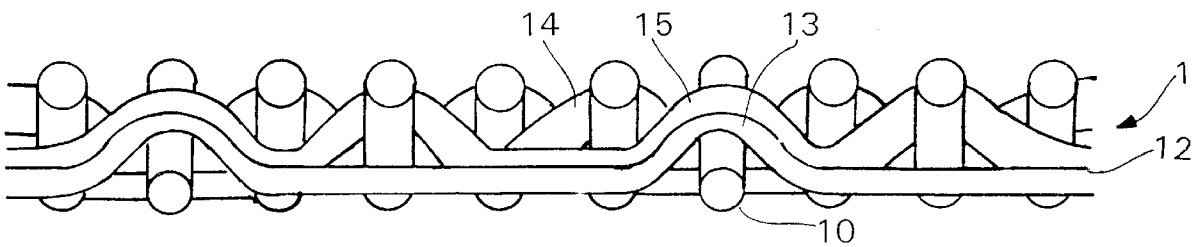
FIG. 7 is a side elevation view of the papermaking fabric taken along line 7—7 in FIG. 6.

As shown in FIGS. 6–8, the smaller diameter CD filament 12 weaves with the MD filaments 10 in a repeat pattern of over one and under four. The larger diameter CD filament 14 weaves with the MD filaments 10 in a repeat pattern of over one, under one, over one, under two. Since the CD repeat lengths relative to the MD yarns 10 are equal, each sheet side knuckle 13 formed by a smaller diameter CD filament 12 is adjacent to and between a pair of sheet side knuckles 15 formed by the larger diameter CD filaments 14. Since the MD filaments 10 are in a relatively higher plane than the smaller diameter CD filaments 12 and float over a number of CD filaments 14, the MD floats 18 dominate the sheet side S of the fabric 1. These higher profile MD floats 18 cause compression in the paper sheet (not shown) when it is on fabric 1.

The combination of the long sheet side MD floats 18 and knuckles of CD filaments 14 forms a rim around the basket-like depressions in the sheet side of fabric 1. The lower plane knuckles of CD filaments 12 do not interfere with the baskets where they appear and the long machine side floats of the CD filaments 12 provide a lower support or base for the fibers. The paper fibers in these basket forms are relatively uncompressed in comparison to the fibers in contact with the MD floats 18 and CD knuckles 15.

Figure 10:
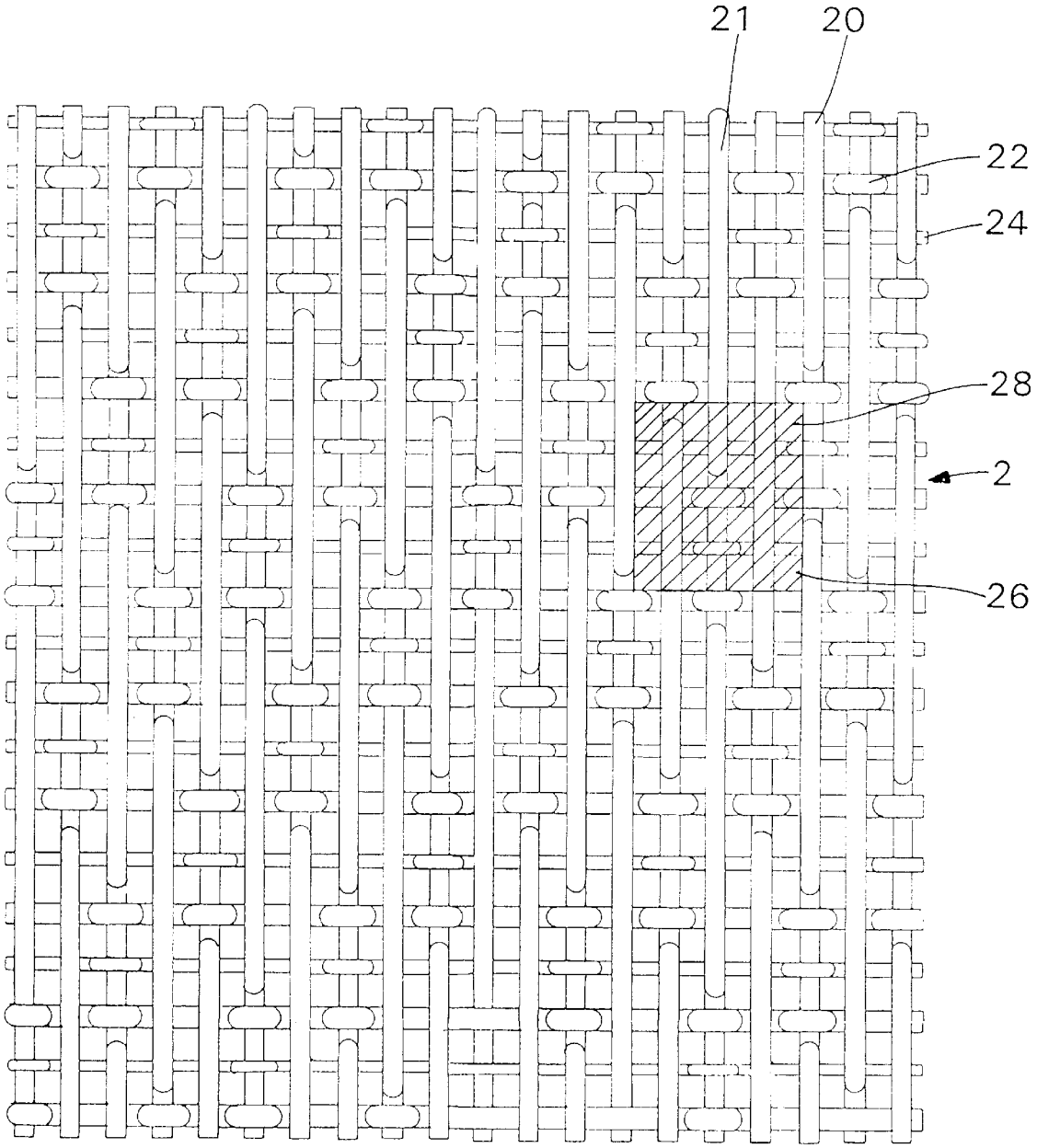
FIG. 10 is an illustration of the knuckles and baskets which are used to create an impression in a paper web according to the present invention.

Each basket is defined by at least two MD filaments 10 on two sides and two larger diameter CD filaments 14 on the remaining two sides. The compression areas on the sheet side of the fabric are aligned in the CD direction and are staggered in the MD direction thereby forming diagonally aligned baskets along the length of the fabric 1. The pattern of the weave causes larger and smaller baskets to form. In a single CD line of baskets, the CD length of the baskets alternates. If the shorter basket is deemed of length 1 then the longer basket is approximately of length 1½. The shorter basket also has slightly less MD length and caliper than the longer baskets. These baskets are illustrated by the darkened areas 26 and 28 in FIG. 10.

Figure 8A:
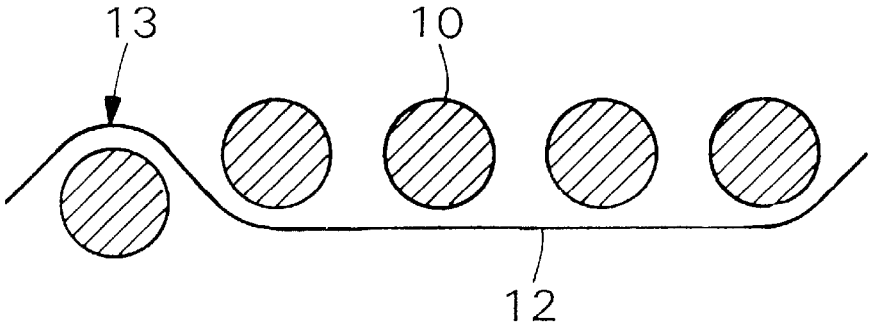
FIGS. 8*a–b* is a series of diagrammatic views illustrating the smaller and larger diameter CD yarn weave patterns for the papermaking fabric of FIG. 2.
Figure 8B:
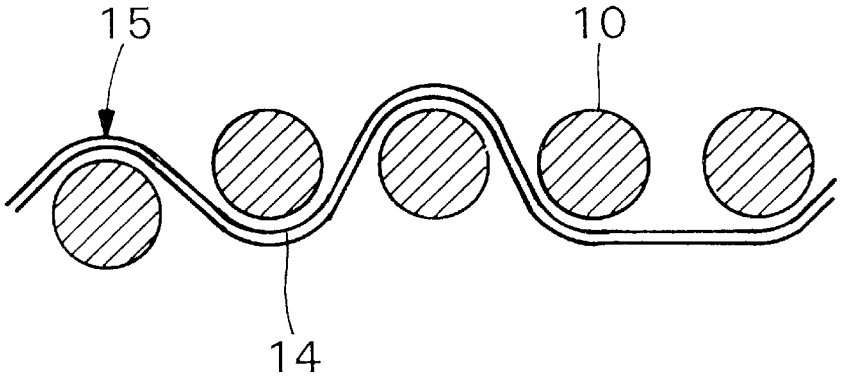

As shown in FIGS. 6, 8*a* and 8*b*, the smaller diameter CD filaments 12 are predominately in the lower portion of the fabric 1 and provide additional support for uncompressed nubs 12 that allow a paper sheet, not shown, to imprint deeply on fabric 1 without fiber bleed through or hole formation. In addition, the location of the smaller diameter CD filaments 12 in the lower portion of the fabric provides the desired additional fiber support without unduly blocking the drainage holes 16, see FIG. 3, in fabric 1.

Figure 9:
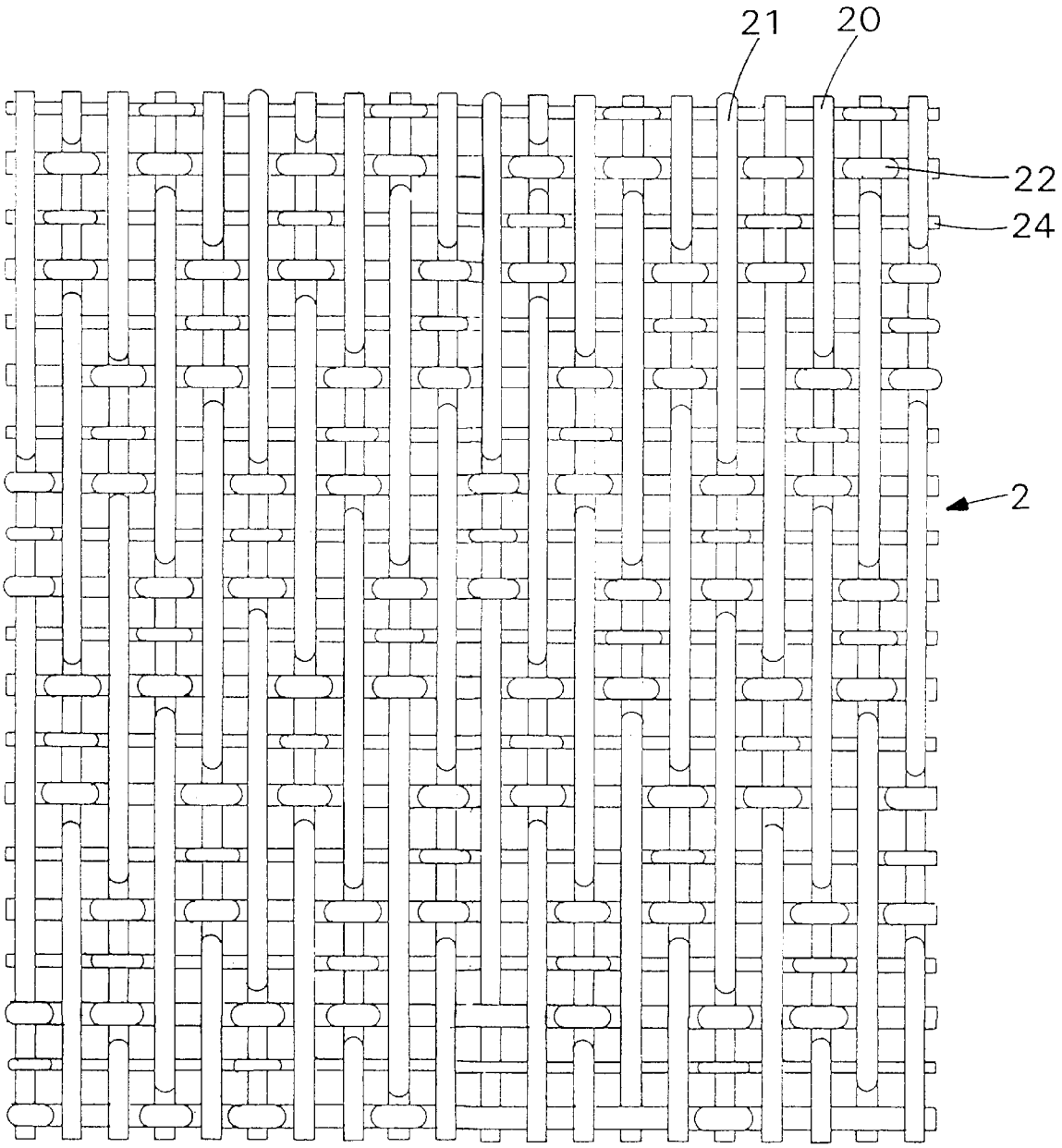
FIG. 9 is a top plan view of an alternate embodiment of the papermaking fabric of FIG. 2.

In an alternate embodiment of the present invention, shown in FIG. 9, the fabric 2 is surfaced to increase the contact area and provide a more monoplane sheet side. The fabric 2 is surfaced until the larger diameter CD filaments 14 are reached at 24. Surfacing of MD and CD filaments 10 and 14 causes additional sheet contact on the added surface area that compresses fibers while the baskets between the surfaced floats 21 and knuckles 24 create areas of uncompressed paper fibers. Large 28 and small 26 baskets are shown by the darkened areas in FIG. 10.

In either embodiment the MD and CD filaments may be polyester, polyamide, vinyl, acrylic, nylon, or other materials as known in the art. In a preferred embodiment of the present invention, the filaments are made of polyester which has been treated for hydrolysis resistance. The MD filaments and CD filaments need not be of the same material. The smaller diameter CD filaments may also differ in composition from the larger MD and CD filaments. For example, hollow, compressible yarns may be utilized instead of solid filaments for the smaller diameter CD filaments. Hollow yarns will provide additional resiliency and compressibility to the fabric. Suitable yarns are described in U.S. Pat. No. 5,368,696 which is incorporated by reference as if fully set forth herein. Preferably, the hollow core of the yarns have a void range of fifteen to thirty percent (15%–30%).

In the preferred embodiment the larger diameter CD filaments 14 range between about 0.3 to 0.6 mm and preferably about 0.4 to 0.5 mm. The smaller diameter CD filaments 2 range between about 0.15 and about 0.3 mm and preferably about 0.2 mm. Preferably, the diameter of the larger CD yarns is at least equal to the diameter of the MD yarns.

In a preferred embodiment of the present invention, the fabric as woven achieves an air permeability of 600 to 800 CFM, most preferably about 700 CFM, as tested on a Frazier air permeability tester. The fabric of the present invention preferably has an open area, as seen in FIG. 3, of ten to twenty-five percent (10%–25%), more preferably 20.0 percent (20.0%).

The MD filaments and the larger CD filaments are preferably monofilaments. The smaller CD yarn or filament may be of any configuration, for example, monofilament, multifilament cable, flat monofilament or flat monofilament with holes therethrough, as will be understood by the skilled artisan.

The ratio of the larger diameter CD filaments to the smaller CD filaments diameter is preferably 1.5:1 to 4:1, more preferably 2:1.

The fabric of the present invention may be woven in an endless configuration or may be woven flat. The description set forth in the present specification is based upon a fabric that has been woven flat with the warp filaments running in the machine direction. It will be apparent to the skilled artisan how the yarns would be reorientated for endless weaving of the fabric.

The fabric according to one embodiment of the present invention has a mesh count of 20 to 50 filaments per inch of cross direction distance, more preferably 30 to 40 filaments per inch of cross direction distance. The fabric according to one embodiment of the present invention has a mesh count sufficient to prevent pinholing of the fibrous web, more preferably a mesh count no less than 20. The fabric according to one embodiment of the present invention has a mesh count of 20 to 50 filaments per inch of machine direction distance, more preferably at least 30 filaments per inch of machine direction distance. The fabric according to one embodiment of the present invention has a mesh count sufficient to prevent pinholing of the fibrous web, more preferably a mesh count of no less than 20.

The fabric of the present invention may be further treated to improve the contact area thereof. Any art recognized method for increasing contact area can be used. Exemplary methods are described in U.S. Pat. No. 3,579,164, which issued Mar. 30, 1971, to Friedberg et al. This patent discloses surfacing or abrading the high points of strand crossovers to provide flat surfaced regions. Contact area refers to the amount of fabric surfacing. The fabric of the present invention preferably has a contact area of 20% to 40%, more preferably 25 to 35%, most preferably about 30%.

The fabric of the present invention may also be described in terms of orientation of the open areas or baskets and contact areas of floats or knuckles. The fabric of the present invention has alternating large and small basket sizes. Basket and nub sizes are measured at the maximum point between two sides and all measurements are based upon the fabric prior to treatments such as abrading to increase contact area. The larger baskets and nubs are larger than about 40 mils by 40 mils, more preferably in the range of about 60 mils by 40 mils to about 120 mils by 100 mils, most preferably about 80 mils by 50 mils. The smaller baskets and nubs are larger than about 20 mils by 30 mils. The baskets also have different depths and thus the corresponding nubs have different heights. The large baskets are preferably about 0.3 to 0.7 mm deep, more preferably about 0.3 to 0.5 mm deep and most preferably about 0.4 mm deep. The smaller baskets are preferably about 0.15 to 0.4 mm deep, more preferably about 0.2 to 0.3 mm deep, and most preferably about 0.25 mm deep. The baskets are tridirectionally aligned. The large and small baskets are aligned in the cross direction and the large and small baskets are each aligned in both diagonal directions.

The web produced according to the present invention preferably has large and small nubs, wherein at least 10% of the area of the web is covered by nubs having a dimension of at least 40 mils by 40 mils, more preferably at least 25% of the areas of the web is covered by nubs that are at least 40 mils by 40 mils and most preferably at least 50% of the area of the web is covered by nubs of at least 40 mils by 40 mils. Unless otherwise specified, the dimensions used herein refer to the measurable size of the baskets in the fabric which create the nubs. The skilled artisan would clearly understand that the dimensions of the nub in the paper web may vary slightly due to processing operations, for example creping.

Figure 1:
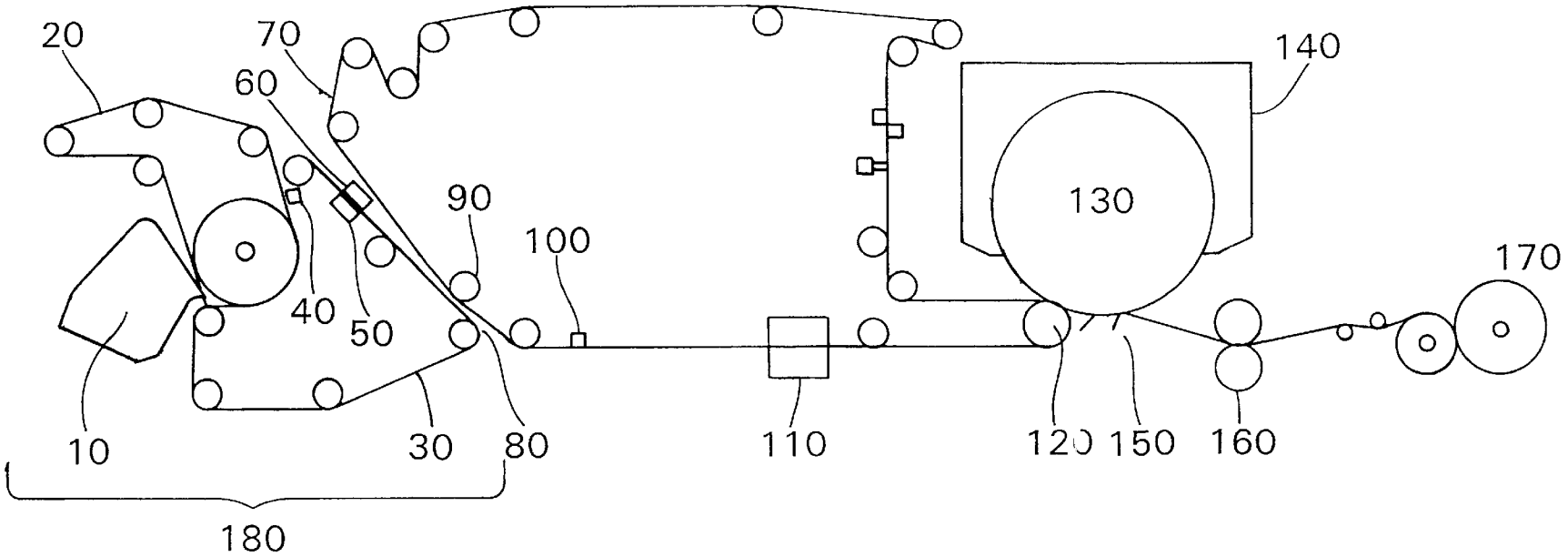
FIG. 1 is an illustration of a process for forming a paper web using a through air dryer paper machine.

The present invention is also directed to a process for making a soft, high bulk and absorbency web. As set forth in FIG. 1, in a TAD process, a web is formed on a forming structure (180) from a liquid slurry of pulp. The pulp is introduced from a headbox (10) to the forming structure. The forming structure can be a twin wire former, a crescent former or any art recognized forming configuration. The web is transferred from the forming structure to a carrier fabric which may also be a TAD impression fabric.

During transfer of the paper web from the forming fabric or a carrier fabric to a TAD fabric, the differential speed of the two fabrics can create a condition which imparts properties to the web similar to creping. The effect of this differential fabric speed has been referred to as fabric/fabric creping. In a preferred embodiment of the present invention, the fabric/fabric crepe is carried out at 0 to 30%, more preferably 5 to 15%, most preferably 7–10%.

After transfer to an impression fabric, the web is passed through a dryer section where hot air is passed through both the web and the fabric to cause substantial drying of the web. The web can then be transferred to another carrier fabric or may be pressed to the surface of a rotating Yankee drier cylinder (130). The remaining moisture within the web as it is laid on the Yankee surface causes the web to adhere to the surface. Liquid adhesive may be applied to the surface of the Yankee. The web is then creped from the surface with a creping blade (150). The web is preferably creped from 0 to 20%, more preferably from 5 to 15% and most preferably 10%. As used herein, percent crepe refers to the speed of the Yankee minus the reel speed divided by the Yankee speed, expressed as percent. The creped web can be passed between calendering rolls and rolled up prior to further converting operation.

As an alternative to adhering the web to the Yankee and creping it from that surface, the web may also in some embodiments be removed directly from the impression fabric.

The web according to the present invention can be made using fibers well known to the skilled artisan. These fibers include softwood, hardwood, chemical pulp obtained from softwood and/or hardwood by treatment with sulfate or sulfite moieties, mechanical pulp obtained by mechanical treatment of softwood and/or hardwood, recycle fiber, refined fiber and the like.

Papermaking fibers used to form the soft absorbent products of the present invention include cellulosic fibers commonly referred to as wood pulp fibers, liberated in the pulping process from softwood (gymnosperms or coniferous trees) and hardwoods (angiosperms or deciduous trees). The particular tree and pulping process used to liberate the tracheid are not critical to the success of the present invention. Cellulosic fibers from diverse material origins may be used to form the web of the present invention, including non-woody fibers liberated from sabai grass, rice straw, banana leaves, paper mulberry (i.e. bast fiber), abaca leaves, pineapple leaves, esparto grass leaves, and fibers from the genus hesperalae in the family agavaceae. Also recycled fibers which may contain any of the above fiber sources in different percentages can be used in the present invention.

Papermaking fibers can be liberated from their source material by any one of the number of chemical pulping processes familiar to the skilled artisan including sulfate, sulfite, polysulfite, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if one wishes, by a number of familiar bleaching schemes including alkaline peroxide and ozone bleaching.

In one preferred embodiment of the present invention, a product is produced using 60–100% softwood fibers. The remaining fibers may be selected from hardwood fibers, eucalyptus fibers, recycled fibers, non-woody fibers or mixtures thereof.

The suspension of the fibers or furnish may contain chemical additives to alter the physical properties of the paper produced. These chemistries are well understood by the skilled artisan and may be used in any known combination.

The pulp can be mixed with strength adjusting agents such as wet strength agents, dry strength agents and debonders/softeners. Suitable wet strength agents will be readily apparent to the skilled artisan. A comprehensive but non exhaustive list of useful wet strength aids include urea-formaldehyde resins, melamine formaldehyde resins, glyoxylated polyacrylamide resins, polyamide-epichlorhydrin resins and the like. Of particular utility is the polyamide-epichlorhydrin resins, an example of which is sold under the tradenames Kymene 557LX and Kymene 557H by Hercules Incorporated of Wilmington, Del. These resins and the process for making the resins are described in U.S. Pat. Nos. 3,700,623 and 3,772,076 each of which is incorporated herein by reference in their entirety. The pulp preferably contains up to about 30 lbs/ton, more preferably from 20 to 30 lbs/ton of wet strength aids.

Suitable dry strength agents will be readily apparent to one skilled in the art. A comprehensive but non-exhaustive list of useful dry strength aids include starch, guar gum, polyacrylamides, carboxymethyl cellulose and the like. Of particular utility is carboxymethyl cellulose, an example of which is sold under the tradename Hercules CMC by Hercules Incorporated of Wilmington, Del. The pulp preferably contains from 0 to 15 lb/ton, more preferably 2 to 5 lbs/ton of dry strength aid.

Suitable debonders will be readily apparent to the skilled artisan. Debonders/softeners may also be incorporated into the pulp or sprayed upon the web after its formation. The pulp preferably contains from 0 to 10 lbs/ton, more preferably from 2 to 5 lbs/ton of debonder/softener.

The present invention may be used with a particular class of softener materials—amido amine salts derived from partially acid neutralized amines. Such materials are disclosed in U.S. Pat. No. 4,720,383. Also relevant are the following articles: Evans, Chemistry and Industry, Jul. 5, 1969, Pp. 893–903; Egan, *J. Am. Oil Chemist's Soc.,* Vol. 55 (1978), Pp. 118–121; and Trivedi et al., *J. Am. Oil Chemist's Soc.,* June 1981, Pp. 754–756. All of the above are herein incorporated by reference in their entirety. As indicated therein, softeners are often available commercially only as complex mixtures rather than as single compounds. While this discussion will focus on the predominant species, it should be understood that commercially available mixtures would generally be used in practice.

Quasoft® 202-JR is a suitable softener material which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amines cyclize to imidazoline compounds. Since only the imidazoline portions of these material are quaternary ammonium compounds, the compositions as a whole are pH-sensitive. Therefore, in the practice of the present invention with this class of chemicals, the pH in the headbox should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096. All of which are incorporated herein by reference in their entirety. These compounds are biodegradable diesters of quaternary ammonia compounds, quaternized amine-esters, biodegradable vegetable oil based esters functional with quaternary ammonium chloride and diester dierucyldimethyl ammonium chloride and are representative biodegradable softeners.

The web may also be adhered to a Yankee dryer. Any suitable art recognized adhesive may be used on the Yankee dryer. Preferred adhesives include polyvinyl alcohol with suitable plasticizers, glyoxylated polyacrylamide with or without polyvinyl alcohol, and polyamide epichlorohydrin resins such as Quacoat A-252 (QA252), Betzcreplus 97 (Betz+97) and Calgon 675 B. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307. Typical release agents can be used in accordance with the present invention.

The process of the present invention results in better dewatering and drying efficiency and fewer pinholes than a process using a fabric with same maximum basket size and/or number of baskets/in$^2$, but not having the extra, small-diameter shutes. This is believed to be due to less air channeling through the fabric and web at the vacuum boxes and at the TAD section of the present invention. Thus, the process of the present invention can achieve greater productivity or, at same production rate can produce webs with larger nubs providing increases in bulk and absorbency.

The fabric and process of the present invention allow the formation of larger nubs without occurrence of pinholes or fiber bleed-through in the web due to the improved web support. Pinholes and fiber bleed-through often occur in an unsupported web as the web is dewatered at high air flows at the pickup shoe and vacuum boxes and as the hot air is blown through the web and fabric in the dryer section. The fabric according to the present invention also allows for the use of fabric to fabric creping without fiber bleed-through. The ability to reduce fiber bleed-through results in less contamination of the paper machine components with fiber.

The fabric as described herein is used in the process of the present invention with the back side, i.e., the side of the fabric having the long warp knuckles, on the sheet side. This orientation provides high surface contact on the Yankee dryer causing an improvement in drying, creping and strength development in the paper web.

The paper web produced according to the present invention has superior bulk and absorbency characteristics. Furthermore, the paper product is more flexible due to the tri-directional array of baskets. The multiple basket size gives a more interesting visual appearance than can be achieved using fabrics having a uniform basket size. The multiple basket heights can result in more inter-ply water holding capacity, particularly in a two-ply towel. Finally, the baskets are perimeterically defined by discontinuous densified regions providing superior strength.

Products produced according to the present invention preferably exhibit characteristics within the following ranges:

| | |
|---|---|
| Cond. Basis Weight (lb/rm) | 9–35 |
| Caliper (mils) | 50–300 |
| MD Dry Tensile (g/3") | 600–3500 |
| CD Dry Tensile (g/3") | 300–3000 |
| (Geometic Mean) GM Dry Tensile (g/3") | 425–3300 |
| MD Stretch (%) | 10 to 40 |
| MD Wet Tensile (g/3") | 120–1400 |
| CD Wet Tensile (g/3") | 60–1200 |
| GM Wet Tensile (g/3") | 85–1300 |
| CD W/D Tensile Ratio | 20–40% |
| Absorbency (2-ply) (g/m$^2$) | 300–700 |
| GM Tensile Modulus (g/in/% strain) (2-ply basis) | 10–100 |

The products produced according to the present invention are preferably tissue and towel webs. One or two-ply tissue or towel products are preferred products according to the present invention.

The following examples are illustrative of the invention embodied herein.

EXAMPLES

Example 1

A fabric was woven using PET monofilaments which had been treated to render them hydrolysis resistant. The large diameter monofilaments were 0.4 mm. The smaller diameter filaments were 0.2 mm. The fabric was woven using all large diameter monofilaments in the machine direction and alternating large and small diameter filaments in the cross direction.

The large diameter MD filaments and large diameter CD filaments were interwoven to create a 7,3 broken twill fabric. The alternating CD filaments were only interwoven to the extent necessary to secure them for support of the fibers. The mesh count for the fabric produced was 35 machine direction filaments per inch and 46 cross direction filaments per inch.

The woven fabric was treated to impart heat and dimensional stability. The fabric was further treated by sanding the MD knuckles to increase the contact area of the web to 28%.

The fabric was then seamed by the known technique by fraying out the ends and backweaving them into the fabric body to form a continuous or endless fabric.

Example 2

A paper web was formed using the fabric made in accordance with Example 1. A pulp containing 94% soft wood kraft was delivered to a forming fabric. Kymene at 28 lbs/ton and carboxymethyl cellulose (CMC) at 4.3 lb/ton were added to the furnish as strength adjusting agents. The wet web was transferred from the forming fabric to a TAD fabric made in accordance with Example 1. The transfer of the web from the forming fabric to the TAD fabric was done at a fabric/fabric crepe level of 0%. Fabric/fabric crepe refers to the relative speeds of the forming fabric and the TAD fabric and can be understood as the difference between the speed of the forming fabric speed and the TAD fabric speed divided by the forming fabric speed, expressed as percent.

The web was imprinted and dried on the TAD fabric using circulating air having an inlet temperature of 389° F. The web moisture after TAD was 61.4%. The web was then pressed onto a Yankee dryer. The web was creped from the Yankee dryer at 8.2% crepe. The web was not calendered. The web formed by the process of the present invention had the physical properties described below in Table 1.

Absorbency was determined using the following method. The sample table was set a fixed distance above a reservoir of water, typically 5 mm. The water reservoir rests on a digital balance so that changes in weight due to water removal from the reservoir by absorption in the sample can be monitored and recorded. A round 2" sample was placed in the sample table over a 3 mm diameter hole which is connected to the water reservoir by a rubber tube. A mechanical pinch of the rubber tube forces water into contact with the sample. The capillary action of the sample draws water out of the reservoir. While the sample is absorbing the instrument is intermittently storing weight and time data. Data points are taken about three times per second which is the maximum rate of the balance. The termination criteria are set at less than a 0.005 g change in the sample weight over a five second time interval. At the end of the test, the instrument transmits the data to an attached computer. The computer acquires the data, performs the necessary calculations and displays the result.

The caliper was measured as the number of mils of thickness of a stack of 8 sample sheets at a pressure of 0.35 psi.

TABLE 1

| | |
|---|---|
| Cond. Basis Weight (lb/rm) | 14.4 |
| Caliper (mils) | 98.5 |
| MD Dry Tensile (g/3") | 2141 |
| CD Dry Tensile (g/3") | 1733 |
| GM Dry Tensile (g/3") | 1924 |
| MD Stretch (%) | 16.3 |
| Tensile Ratio | 1.24 |
| MD Wet Tensile (g/3") | 628 |
| CD Wet Tensile (g/3") | 550 |
| GM Wet Tensile (g/3") | 587 |
| CD W/D Ratio | 32% |
| Absorbency (2-ply) (g/m$^2$) | 460 |
| GM Tensile Modulus (g/in/% strain) (2-ply basis) | 67.2 |

EXAMPLE 3

A paper web was formed using the fabric made in accordance with Example 1. A pulp containing 95% soft wood kraft was delivered to a forming fabric. Kymene at 28 lbs/ton and CMC at 4.3 lbs/ton were added to the furnish as strength adjusting agents. The wet web was transferred from the forming fabric to a TAD fabric made in accordance with Example 1. The transfer of the web from the forming fabric to the TAD fabric was done at a fabric/fabric crepe level of 0%.

The web was imprinted and dried on the TAD fabric using circulating air having an inlet temperature of 369° F. The web moisture after TAD was 62.85%. The web was then pressed onto a Yankee dryer. The web was creped from the Yankee dryer at 10.1% crepe and not calendered. The web formed by the process of the present invention had the physical properties described below in Table 2.

TABLE 2

| | |
|---|---|
| Cond. Basis Weight (lb/rm) | 14.3 |
| Caliper (mils) | 102.8 |
| MD Dry Tensile (g/3") | 1877 |
| CD Dry Tensile (g/3") | 1570 |
| GM Dry Tensile (g/3") | 1717 |
| MD Stretch (%) | 20.4 |
| Tensile Ratio | 1.20 |
| MD Wet Tensile (g/3") | 511 |
| CD Wet Tensile (g/3") | 451 |
| GM Wet Tensile (g/3") | 480 |
| CD W/D Ratio | 29% |
| Absorbency (2-ply) (g/m$^2$) | 491 |
| GM Tensile Modulus (g/in/% strain) (2-ply basis) | 54.5 |

Example 4

A paper web was formed using the fabric made in accordance with Example 1. A pulp containing 95% soft wood kraft was delivered to a forming fabric. Kymene at 28 lbs/ton and CMC at 4.3 lbs/ton were added to the furnish as strength adjusting agents. The wet web was transferred from the forming fabric to a TAD fabric made in accordance with Example 1. The transfer of the web from the forming fabric to the TAD fabric was done at a fabric/fabric crepe level of 5.7%.

The web was imprinted and dried on the TAD fabric using circulating air having an inlet temperature of 415° F. The web moisture after TAD was 65.71%. The web was then pressed onto a Yankee dryer. The web was creped from the Yankee dryer at 10.1% crepe and not calendered. The web formed by the process of the present invention had the physical properties described below in Table 3.

TABLE 3

| | |
|---|---|
| Cond. Basis Weight (lb/rm) | 14.4 |
| Caliper (mils) | 115.0 |
| MD Dry Tensile (g/3") | 1897 |
| CD Dry Tensile (g/3") | 1517 |
| GM Dry Tensile (g/3") | 1696 |
| MD Stretch (%) | 23.1 |
| Tensile Ratio | 1.25 |
| MD Wet Tensile (g/3") | 569 |
| CD Wet Tensile (g/3") | 459 |
| GM Wet Tensile (g/3") | 511 |
| CD W/D Ratio | 30% |
| Absorbency (2-ply) (g/m$^2$) | 567 |
| GM Tensile Modulus (g/in/% strain) (2-ply basis) | 45.0 |

Example 5

A paper web was formed using the fabric made in accordance with Example 1. A pulp containing 95% soft wood kraft was delivered to a forming fabric. Kymene at 28 lbs/ton and CMC at 4.3 lbs/ton were added to the furnish as strength adjusting agents. The wet web was transferred from the forming fabric to a TAD fabric made in accordance with Example 1. The transfer of the web from the forming fabric to the TAD fabric was done at a fabric/fabric crepe level of 5.7%.

The web was imprinted and dried on the TAD fabric using circulating air having an inlet temperature of 433° F. The web was then pressed onto a Yankee dryer. The web was creped from the Yankee dryer at 1.6% crepe and not calendered. The web formed by the process of the present invention had the physical properties described below in Table 4.

TABLE 4

| | |
|---|---|
| Cond. Basis Weight (lb/rm) | 14.1 |
| Caliper (mils) | 93.6 |
| MD Dry Tensile (g/3") | 2530 |
| CD Dry Tensile (g/3") | 1379 |
| GM Dry Tensile (g/3") | 1867 |
| MD Stretch (%) | 11.8 |
| Tensile Ratio | 1.8 |
| MD Wet Tensile (g/3") | 739 |
| CD Wet Tensile (g/3") | 424 |
| GM Wet Tensile (g/3") | 560 |
| CD W/D Ratio | 31% |
| Absorbency (g/m$^2$) (Two Ply) | 460 |
| GM Tensile Modulus (g/in/% strain) (2-ply basis) | 918 |

Example 6

A two-ply towel product was produced by adhering two webs together that were produced in accordance with Example 3. The two webs were embossed and adhered using HB FULLER WB-2722EN adhesive (5% solids). The physical properties of the product are set forth in Table 5, below.

TABLE 5

| | |
|---|---|
| Basis Weight (lb/rm) | 25.7 |
| Caliper (mils) | 181.5 |
| MD Dry Tensile (g/3") | 2612 |
| CD Dry Tensile (g/3") | 1968 |
| GM Dry Tensile (g/3") | 2265 |
| MD Stretch (%) | 10.3 |
| Tensile Ratio | 1.3 |
| GM Tensile Modulus (g/in/% St) | 43.5 |
| CD Wet Tensile (g/3") | 607 |
| CD W/D Ratio (%) | 30.8 |
| Absorbency (g/m$^2$) | 409 |
| Perf Tensile (g/3") | 533 |
| Ply Bond | 13.1 |
| Roll Diameter (in.) | 5.1 |
| Roll Compression (%) | 10.5 |

The resulting product is soft, absorbent and has high permanent wet strength, suitable for use as a paper towel.

Example 7

A two-ply towel product was produced by adhering two webs together that were produced in accordance with Example 2. The two webs were embossed and adhered using HB FULLER WB-2722EN adhesive (5% solids). The physical properties of the product are set forth in Table 6, below.

TABLE 6

| | |
|---|---|
| Basis Weight (lb/rm) | 26.7 |
| Caliper (mils) | 181.8 |
| MD Dry Tensile (g/3") | 2921 |
| CD Dry Tensile (g/3") | 2239 |
| GM Dry Tensile (g/3") | 2555 |
| MD Stretch (%) | 8.5 |
| Tensile Ratio | 1.3 |
| GM Tensile Modulus (g/in/% St) | 56.3 |
| CD Wet Tensile (g/3") | 690 |
| CD W/D Ratio (%) | 30.8 |
| Absorbency (g/m$^2$) | 402 |
| Perf Tensile (g/3") | 613 |
| Ply Bond | 13.6 |

TABLE 6-continued

| | |
|---|---|
| Roll Diameter (in.) | 5.1 |
| Roll Compression (%) | 9.9 |

The resulting product is soft, absorbent and has high permanent wet strength, suitable for use as a paper towel.

Example 8

A two-ply towel product was produced by adhering two webs together that were produced in accordance with Example 3. The two webs were embossed and adhered using HB FULLER WB-2733 adhesive (5% solids). The physical properties of the product are set forth in Table 7, below.

TABLE 7

| | |
|---|---|
| Basis Weight (lb/rm) | 25.9 |
| Caliper (mils) | 181.7 |
| MD Dry Tensile (g/3") | 2719 |
| CD Dry Tensile (g/3") | 2066 |
| GM Dry Tensile (g/3") | 2368 |
| MD Stretch (%) | 9.6 |
| Tensile Ratio | 1.3 |
| GM Tensile Modulus (g/in/% St) | 48.0 |
| CD Wet Tensile (g/3") | 624 |
| CD W/D Ratio (%) | 30.2 |
| Absorbency (g/m$^2$) | 406 |
| Perf Tensile (g/3") | 557 |
| Ply Bond | 25.6 |
| Roll Diameter (in.) | 5.2 |
| Roll Compression (%) | 11.8 |

The resulting product is soft, absorbent and has high permanent wet strength, suitable for use as a paper towel.

Example 9

A two-ply towel product was produced by adhering two webs together that were produced in accordance with Example 2. The two webs were embossed and adhered using HB FULLER WB-2733 adhesive (5% solids). The physical properties of the product are set forth in Table 8, below.

TABLE 8

| | |
|---|---|
| Basis Weight (lb/rm) | 26.0 |
| Caliper (mils) | 184.9 |
| MD Dry Tensile (g/3") | 2678 |
| CD Dry Tensile (g/3") | 2170 |
| GM Dry Tensile (g/3") | 2410 |
| MD Stretch (%) | 7.0 |
| Tensile Ratio | 1.23 |
| GM Tensile Modulus (g/in/% St) | 57.2 |
| CD Wet Tensile (g/3") | 649 |
| CD W/D Ratio (%) | 29.9 |
| Absorbency (g/m$^2$) | 389 |
| Perf Tensile (g/3") | 569 |
| Ply Bond | 26.1 |
| Roll Diameter (in.) | 5.2 |
| Roll Compression (%) | 12.2 |

The resulting product is soft, absorbent, and has high permanent wet strength, suitable for use as a paper towel.

Example 10

A two-ply towel product was produced by adhering two webs together that were produced in accordance with Example 3. The two webs were embossed and adhered using SWIFT 47925 adhesive (5% solids). The physical properties of the product are set forth in Table 9, below.

TABLE 9

| | |
|---|---|
| Basis Weight (lb/rm) | 25.9 |
| Caliper (mils) | 181.7 |
| MD Dry Tensile (g/3") | 2719 |
| CD Dry Tensile (g/3") | 2066 |
| GM Dry Tensile (g/3") | 2368 |
| MD Stretch (%) | 9.6 |
| Tensile Ratio | 1.3 |
| GM Tensile Modulus (g/in/% St) | 48.0 |
| CD Wet Tensile (g/3") | 624 |
| CD W/D Ratio (%) | 30.2 |
| Absorbency (g/m$^2$) | 406 |
| Perf Tensile (g/3") | 557 |
| Ply Bond | 25.6 |
| Roll Diameter (in.) | 5.2 |
| Roll Compression (%) | 11.8 |

The resulting product is soft, absorbent and has high permanent wet strength, suitable for use as a paper towel.

Example 11

A two-ply towel product was produced by adhering two webs together that were produced in accordance with Example 2. The two webs were embossed and adhered using SWIFT 47925 adhesive (5% solids). The physical properties of the product are set forth in Table 10, below.

TABLE 10

| | |
|---|---|
| Basis Weight (lb/rm) | 26.5 |
| Caliper (mils) | 179.5 |
| MD Dry Tensile (g/3") | 3005 |
| CD Dry Tensile (g/3") | 2321 |
| GM Dry Tensile (g/3") | 2640 |
| MD Stretch (%) | 8.4 |
| Tensile Ratio | 1.3 |
| GM Tensile Modulus (g/in/% St) | 62.2 |
| CD Wet Tensile (g/3") | 727 |
| CD W/D Ratio (%) | 31.3 |
| Absorbency (g/m$^2$) | 396 |
| Perf Tensile (g/3") | 653 |
| Ply Bond | 24.9 |
| Roll Diameter (in.) | 5.2 |
| Roll Compression (%) | 12.5 |

The resulting product is soft, absorbent and has high permanent wet strength, suitable for use as a paper towel.

Example 12

A two-ply towel product was produced by adhering two webs together that were produced in accordance with Examples 3 and 4. The two webs were embossed and adhered using HB FULLER WB2733 adhesive (4.2% solids). The physical properties of the products are set forth in Table 11, below.

TABLE 11

| Property | Ex. 3 web | Ex. 4 web |
|---|---|---|
| Basis Weight (lb/rm) | 26.0 | 26.4 |
| Caliper (mils) | 183.2 | 189.2 |
| MD Dry Tensile (g/3") | 2651 | 2988 |
| CD Dry Tensile (g/3") | 2011 | 2061 |
| GM Dry Tensile (g/3") | — | — |
| MD Stretch (%) | 11.1 | 14.0 |
| Tensile Ratio | — | — |
| GM Tensile Modulus (g/in/% St) | 48.3 | 41.9 |
| CD Wet Tensile (g/3") | 616 | 681 |
| CD W/D Ratio (%) | — | — |
| Absorbency (2-ply) (g/m$^2$) | 415.2 | 470.2 |

TABLE 11-continued

| Property | Ex. 3 web | Ex. 4 web |
|---|---|---|
| Perf Tensile (g/3") | 717 | 755 |
| Ply Bond | 10.4 | 9.4 |
| Roll Diameter (in.) | 5.2 | 5.2 |
| Roll Compression (%) | 13.0 | 10.3 |

The resulting products are soft, absorbent and have high permanent wet strength, suitable for use as a paper towel.

Example 13

A single ply toilet tissue product was made using the TAD fabric described in Example 1. Refining was used to control overall strength levels. The web was transferred from the forming fabric to a TAD fabric made in accordance with Example 1. The transfer of the web from the forming fabric to the TAD fabric was done at a fabric/fabric crepe level of 0%. After creping the web was calendered and embossed into a finished product. The physical properties of the product are set forth in Table 12, below.

TABLE 12

| | |
|---|---|
| Basis Weight (lb/rm) | 14.5 |
| Caliper (mils) | 70.7 |
| MD Dry Tensile (g/3") | 687 |
| CD Dry Tensile (g/3") | 328 |
| GM Dry Tensile (g/3") | 475 |
| MD Stretch (%) | 11.4 |
| Tensile Ratio | 2.10 |
| GM Tensile Modulus (g/in/% St) | 14.7 |
| Perf Tensile (g/3") | 299 |
| Roll Diameter (in.) | 4.17 |
| Roll Compression (%) | 18.2 |

The resulting product is soft and strong, suitable for use as a bathroom tissue.

Other embodiments of the invention will be apparent to those skilled in the art from consideration of the specification and practice of the invention described herein. It is intended that the specification and examples disclosed herein be exemplary only, with a true scope and spirit of the invention being intended by the following claims.

We claim:

1. A papermaker's fabric for forming and transporting an aqueous paper web comprising a single layer fabric having machine direction filaments interwoven with alternating smaller and larger cross direction filaments to form a pattern of knuckles and baskets, the fabric characterized by: each machine direction filament being woven over seven cross direction filaments, three of said seven cross direction filaments of each MD sheet side float being of the larger diameter and four of said seven cross direction filaments being of the smaller diameter, and the smaller diameter cross direction filaments forming central support members at the bottom of said baskets.

2. The papermaker's fabric of claim 1, wherein each machine direction filament is woven under three cross direction filaments, wherein two of said three cross direction filaments are of the larger diameter and one of said three cross direction filaments is of the smaller diameter.

3. The papermaker's fabric of claim 1, wherein the machine direction filaments and the larger diameter cross direction filaments are of an equal diameter.

4. The papermaker's fabric of claim 1, wherein the machine direction filaments and the cross direction filaments are all monofilaments.

5. The papermaker's fabric of claim 1, wherein the fabric has a mesh count in the cross direction of from 20 to 50 filaments per inch.

6. The papermaker's fabric of claim 1, wherein the fabric has a mesh count in the machine direction of from 20 to 50 filaments per inch.

7. The papermakers fabric of claim 1, wherein the fabric is sanded on the sheet side.

8. The papermaker's fabric of claim 7, wherein the fabric is sanded to a contact area of 20 to 40%.

9. The papermaker's fabric of claim 1, wherein the fabric is a forming fabric.

10. In combination with a papermaking through air dryer apparatus having at least one through-dryer position, a through-dryer papermaking fabric comprising:

a single layer fabric having machine direction filaments interwoven with alternating smaller and larger cross machine filaments to form a pattern of knuckles and basket; the MD filaments forming sheet side floats in the MD direction that have a minimum length of seven CD system filaments, and the smaller CD filaments forming machine side floats in the CD direction that have a minimum length of four MD system filaments.

11. A papermaking fabric having a sheet side and a machine side comprised of:

a system of MD filaments selectively interwoven with a system of CD filaments having alternating smaller and larger filaments, the MD filaments forming sheet side floats in the MD direction that have a minimum length of seven CD system filaments, and the smaller CD filaments forming machine side floats in the CD direction that have a minimum length of four MD system filaments whereby the weave forms a plurality of basket-like depressions in the sheet side of the fabric.

12. The fabric of claim 11, wherein sheet side knuckles formed by the smaller diameter CD filaments coincide with sheet side knuckles of the larger diameter CD filaments.

13. A papermaking fabric having a sheet side and a machine side comprised of:

a system of MD filaments selectively interwoven with a system of CD filaments having at least two subsets of smaller and larger filaments, the MD filaments forming sheet side floats in the MD direction that have a minimum length of seven CD system filaments, and the smaller CD filaments weave in a repeat pattern of under four, over one MD filament whereby the weave forms a plurality of basket-like depressions in the sheet side of the fabric.

14. A papermaking fabric having a sheet side and a machine side comprised of:

a system of MD filaments selectively interwoven with a system of CD filaments having at least two subsets of smaller and larger filaments, the MD filaments forming sheet side floats in the MD direction that have a minimum length of seven CD system filaments, the larger CD filaments weaving in a repeat pattern of over one, under one, over one, under two MD filaments and the smaller CD filaments forming machine side floats in the CD direction that have a minimum length of four MD system filaments whereby the weave forms a plurality of basket-like depressions in the sheet side of the fabric.

15. A papermaking fabric having a sheet side and a machine side comprised of:

a system of MD filaments selectively interwoven with a system of CD filaments having at least two subsets of smaller and larger filaments, the MD filaments forming sheet side floats in the MD direction that have a minimum length of seven CD system filaments, the smaller CD filaments weave in a repeat pattern of under four MD filaments, over one MD filament and the knuckles formed by the smaller diameter CD filaments coincide with knuckles of the larger diameter CD filaments whereby the weave forms a plurality of basket-like depressions in the sheet side of the fabric.

16. The fabric of claim 15, wherein the smaller CD filament's over one knuckle is adjacent to and between a pair of larger CD filament knuckles.

17. A papermaking fabric having a sheet side and a machine side comprised of:

a system of MD filaments selectively interwoven with a system of CD filaments, the MD filaments forming sheet side floats in the MD direction that have a minimum float of seven CD system filaments;

the CD filaments having at least two subsets of filaments that have larger and smaller diameter filaments;

the larger diameter CD filaments define only knuckles on the sheet side; and the smaller diameter CD filaments define only sheet side knuckles and machine side floats;

whereby the weave forms a plurality of depressions in the sheet side of the fabric.

18. A papermaking fabric having a sheet side and a machine side comprised of:

a system of MD filaments selectively interwoven with a system of CD filaments, the MD filaments forming sheet side floats in the MD direction that have a minimum float of seven CD system filaments;

the CD filaments having at least two subsets of filaments that have larger and smaller diameter filaments;

the larger diameter CD filaments define only knuckles on the sheet side;

the smaller diameter CD filaments define only sheet side knuckles and machine side floats; and the sheet side knuckles formed by the smaller diameter CD filaments coincide with the sheet side knuckles formed by the larger diameter CD filaments;

whereby the weave forms a plurality of depressions in the sheet side of the fabric.

* * * * *

UNITED STATES PATENT AND TRADEMARK OFFICE
CERTIFICATE OF CORRECTION

PATENT NO. : 5,853,547

DATED : December 29, 1998

INVENTOR(S) : Ahrens et al.

It is certified that error appears in the above-identified patent and that said Letters Patent is hereby corrected as shown below:

ON THE TITLE PAGE, ITEM [22],

Related U.S. application data, after "abandoned." insert --Provisional application No. 60/012,696, February 29, 1996.--.

In column 1, line 7, after "doned." insert --This application claims priority from U.S. provisional application Ser. No. 60/012,696, filed February 29, 1996.--.

In "Table 4", at column 15, line 16, delete "918" and insert --91.8-- therefor.

Signed and Sealed this

Eighth Day of June, 1999

*Attest:*

Q. TODD DICKINSON

*Attesting Officer*

*Acting Commissioner of Patents and Trademarks*